US009387485B2

(12) United States Patent
Michailovski et al.

(10) Patent No.: US 9,387,485 B2
(45) Date of Patent: Jul. 12, 2016

(54) MAGNETIC SEPARATION OF PARTICLES INCLUDING ONE-STEP-CONDITIONING OF A PULP

(71) Applicant: BASF SE, Ludwigshafen (DE)

(72) Inventors: Alexej Michailovski, Ludwigshafen (DE); Piyada Charoensirisomboon, Mannheim (DE); Reinhold Rieger, Mutterstadt (DE); Imme Domke, Jersey City, NJ (US); Igor Shishkov, Mannheim (DE); Hua Wu, Zurich (CH); Xinya Zhang, Dübendorf (CH); Massimo Morbidelli, Zurich (CH)

(73) Assignee: BASF SE (DE)

( * ) Notice: Subject to any disclaimer, the term of this patent is extended or adjusted under 35 U.S.C. 154(b) by 450 days.

(21) Appl. No.: 13/866,613

(22) Filed: Apr. 19, 2013

(65) Prior Publication Data

US 2013/0319912 A1 Dec. 5, 2013

Related U.S. Application Data

(60) Provisional application No. 61/636,756, filed on Apr. 23, 2012.

(51) Int. Cl.
*B03C 1/01* (2006.01)

(52) U.S. Cl.
CPC ..... *B03C 1/01* (2013.01)

(58) Field of Classification Search
CPC ..... B03C 1/01
See application file for complete search history.

(56) References Cited

U.S. PATENT DOCUMENTS

| | | | |
|---|---|---|---|
| 4,657,666 A | 4/1987 | Snook et al. | |
| 4,834,898 A | 5/1989 | Hwang | |
| 8,318,025 B2 | 11/2012 | Domke et al. | |
| 2010/0300941 A1* | 12/2010 | Domke | B03C 1/015 209/8 |
| 2011/0240527 A1 | 10/2011 | Domke et al. | |
| 2011/0272623 A1 | 11/2011 | Domke et al. | |
| 2011/0303772 A1 | 12/2011 | Michailovski et al. | |
| 2012/0058463 A1 | 3/2012 | Deuerlein et al. | |
| 2012/0132032 A1 | 5/2012 | Domke et al. | |
| 2012/0228413 A1 | 9/2012 | Rieger et al. | |
| 2012/0264111 A1 | 10/2012 | Deuerlein et al. | |

FOREIGN PATENT DOCUMENTS

| | | |
|---|---|---|
| EP | 1200408 A2 | 5/2002 |
| WO | WO-02/0066168 A1 | 8/2002 |
| WO | WO-2007008322 A1 | 1/2007 |
| WO | WO-2009030669 A2 | 3/2009 |
| WO | WO-2011058039 A1 | 5/2011 |
| WO | WO-2012072615 A1 | 6/2012 |

OTHER PUBLICATIONS

International Search Report and Written Opinion for PCT/EP2013/058245, mailing date Sep. 3, 2013.
S. R. Gray, D. Landberg, N. B. Gray, Extractive Metallurgy Conference, Perth, Oct. 2-4, 1991, pp. 223-226.

* cited by examiner

*Primary Examiner* — David A Reifsnyder
(74) *Attorney, Agent, or Firm* — Drinker Biddle & Reath LLP

(57) ABSTRACT

The present invention relates to a process for separating at least one first material from a mixture comprising this at least one first material and at least one second material, which comprises contacting of the mixture comprising at least one first material and at least one second material with at least one magnetic particle, or contacting of the mixture comprising at least one first material and at least one second material with at least one magnetic particle and at least one surface-modifying substance at the same time, contacting of the mixture from step (A) with at least one surface-modifying substance, if this has not been done in step (A), so that the at least one first material, the at least one surface-modifying substance and the at least one magnetic particle become attached to one another, and separation of the addition product by application of a magnetic field.

12 Claims, 1 Drawing Sheet

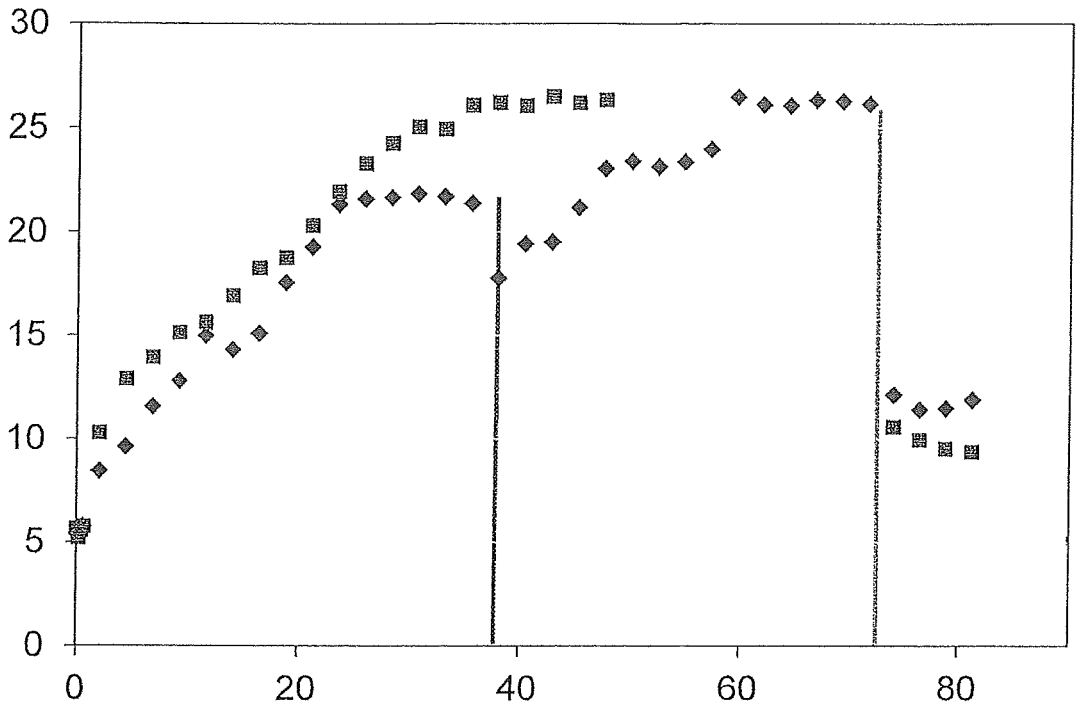
30
25
20
15
10
5
0
0
20
40
60
80

MAGNETIC SEPARATION OF PARTICLES INCLUDING ONE-STEP-CONDITIONING OF A PULP

CROSS-REFERENCE TO RELATED APPLICATIONS

This application claims benefit (under 35 USC 119(e)) of U.S. Provisional Application 61/636,756, filed Apr. 23, 2012, which is incorporated by reference.

BACKGROUND OF THE INVENTION

Description

The present invention relates to a process for separating at least one first material from a mixture comprising this at least one first material and at least one second material, which comprises the following steps (A) contacting of the mixture comprising at least one first material and at least one second material with at least one magnetic particle, if appropriate in the presence of at least one dispersant, or contacting of the mixture comprising at least one first material and at least one second material with at least one magnetic particle and at least one surface-modifying substance at the same time, so that the at least one first material, the at least one surface-modifying substance and the at least one magnetic particle become attached to one another, if appropriate in the presence of at least one dispersant, (B) if appropriate, addition of at least one dispersant to the mixture obtained in step (A) to give a dispersion having a suitable concentration, (C) contacting of the mixture from step (A) or (B) with at least one surface-modifying substance, if this has not been done in step (A), so that the at least one first material, the at least one surface-modifying substance and the at least one magnetic particle become attached to one another, (D) separation of the addition product from step (A), (B) or (C) from the mixture by application of a magnetic field, (E) if appropriate, cleavage of the addition product which has been separated off in step (D) to obtain the at least one first material and the at least one magnetic particle separately.

In particular, the present invention relates to a process for the enrichment of ores in the presence of the gangue.

Processes for separating ores from mixtures comprising these are already known from the prior art.

WO 02/0066168 A1 relates to a process for separating ores from mixtures comprising these, in which suspensions or slurries of these mixtures are treated with particles which are magnetic and/or capable of floating in aqueous solutions. After addition of the magnetic particles and/or particles capable of floating, a magnetic field is applied so that the agglomerates are separated off from the mixture. However, the extent to which the magnetic particles are bound to the ore and the strength of the bond is not sufficient for the process to be carried out with a satisfactorily high yield and effectiveness.

U.S. Pat. No. 4,657,666 discloses a process for the enrichment of ores, in which the ore present in the gangue is treated with magnetic particles, as a result of which agglomerates are formed due to the hydrophobic interactions. The magnetic particles are hydrophobized on the surface by treatment with hydrophobic compounds, so that attachment to the ore occurs. The agglomerates are then separated off from the mixture by means of a magnetic field. The cited document also discloses that the ores are treated with a surface-activating solution of 1% sodium ethylxanthogenate before the magnetic particle is added. In this process, separation of ore and magnetic particle is effected by the destruction of the surface-activating substance which has been applied in the form of the surface-activating solution to the ore. Furthermore, in this process only $C_4$-hydrophobising agents are used for the ore.

U.S. Pat. No. 4,834,898 discloses a process for separating off nonmagnetic materials by bringing them into contact with magnetic reagents which are enveloped by two layers of surface-modifying substances. U.S. Pat. No. 4,834,898 also discloses that the surface charge of the nonmagnetic particles which are to be separated off can be influenced by various types and concentrations of electrolytes reagents. For example, the surface charge is altered by addition of multivalent anions, for example tripolyphosphate ions.

S. R. Gray, D. Landberg, N. B. Gray, Extractive Metallurgy Conference, Perth, 2-4 Oct. 1991, pages 223-226, disclose a process for recovering small gold particles by bringing the particles into contact with magnetite. Before contacting, the gold particles are treated with potassium amylxanthogenate. A process for separating the gold particles from at least one hydrophilic material is not disclosed in this document.

WO 2007/008322 A1 discloses a magnetic particle which is hydrophobized on the surface for separating impurities from mineral substances by magnetic separation processes. According to WO 2007/008322 A1, a dispersant selected from among sodium silicate, sodium polyacrylate and sodium hexametaphosphate can be added to the solution or dispersion.

WO2009/030669 A1 discloses a process for separating at least one first material from a mixture comprising this at least one first material and at least one second material, in which the first material is firstly brought into contact with a surface-modifying substance to hydrophobize it, this mixture is then brought into contact with at least one magnetic particle so that the magnetic particle and the hydrophobized first material become attached to one another and this agglomerate is separated from the at least one second material by application of a magnetic field. The at least one first material is subsequently separated, preferably quantitatively, from the magnetic particle, with the magnetic particle preferably being able to be recirculated to the process. This document does not disclose that the addition of magnetic particles prior to a surface-modifying substance or the addition of magnetic particles and a surface-modifying substance at the same time gives rise to certain advantages like accelerated agglomeration.

It is an object of the present invention to provide a process by means of which at least one first material can be efficiently separated from mixtures comprising at least one first material and at least one second material. A further object of the present invention is to treat the first particles to be separated off in such a way that the addition product of magnetic particle and first material is sufficiently stable to ensure a high yield of the first material in the separation.

A further object is to provide a process for separating particles from a mixture comprising them and other particles, using magnetic particles to obtain magnetic agglomerates of particles to be separated and magnetic particles, wherein the agglomeration occurs faster and more evenly than in processes of the prior art.

These objects are achieved by a process for separating at least one first material from a mixture comprising this at least one first material and at least one second material, which comprises the following steps:

(A) contacting of the mixture comprising at least one first material and at least one second material with at least one magnetic particle, if appropriate in the presence of at least one dispersant, or contacting of the mixture comprising at least one first material and at least one second material with at least one magnetic particle and at least one surface-modifying substance at the same time, so that the at least one first material, the at least one surface-modifying substance and the at least one magnetic particle become attached to one another, if appropriate in the presence of at least one dispersant, (B) if appropriate, addition of at least one dispersant to the mixture obtained in step (A) to give a dispersion having a suitable concentration, (C) contacting of the mixture from step (A) or (B) with at least one surface-modifying substance, if this has not been done in step (A), so that the at least one first material, the at least one surface-modifying substance and the at least one magnetic particle become attached to one another, (D) separation of the addition product from step (A), (B) or (C) from the mixture by application of a magnetic field, (E) if appropriate, cleavage of the addition product which has been separated off in step (D) to obtain the at least one first material and the at least one magnetic particle separately.

BRIEF DESCRIPTION OF THE FIGURE

FIG. 1 shows a diagram, wherein a process for separating valuables from the gangue of an ore according to the prior art, wherein surface-modifying substance and magnetite are added in two steps (diamonds) is compared to the process according to the present invention, wherein surface-modifying substance and magnetite are added in one step (square). The x-axis shows time in minutes, the y-axis shows a value that is corresponding to the particle size in μm.

The process of the invention is preferably employed for separating at least one first, hydrophobic material from a mixture comprising this at least one first, hydrophobic material and at least one second, hydrophilic material.

For the purposes of the present invention, "hydrophobic" means that the corresponding particle can subsequently be hydrophobized by treatment with the at least one surface-modifying substance.

It is also possible for a particle which is hydrophobic per se to be additionally hydrophobized by treatment with the at least one surface-modifying substance.

Within the scope of the present invention, "hydrophobic" means that the surface of corresponding "hydrophobic substances", and, respectively, of a "hydrophobized substance" has a contact angle with water against air of >90°. In the scope of the present invention, "hydrophilic" means that the surface of corresponding "hydrophilic substance" has a contact angle with water against air of <90°.

In a preferred embodiment of the process of the invention, the at least one first material is at least one hydrophobic metal compound or coal and the at least one second material is preferably at least one hydrophilic metal compound.

In a further preferred embodiment of the process according to the present invention, the at least one hydrophobic metal compound is selected from the group consisting of sulfidic ores, oxidic ores, carbonate-comprising ores, noble metals in elemental form, compounds comprising noble metals and mixtures thereof.

The present invention therefore preferably relates to the process according to the present invention, wherein the at least one hydrophobic metal compound is selected from the group consisting of sulfidic ores, oxidic ores, carbonate-comprising ores, noble metals in elemental form, compounds comprising noble metals and mixtures thereof.

In a further preferred embodiment of the process according to the present invention, the at least one hydrophilic metal compound is selected from the group consisting of oxidic metal compounds, hydroxidic metal compounds and mixtures thereof.

The present invention therefore preferably relates to the process according to the present invention, wherein the at least one hydrophilic metal compound is selected from the group consisting of oxidic metal compounds, hydroxidic metal compounds and mixtures thereof.

Examples of the at least one first material to be separated off are preferably metal compounds selected from the group consisting of sufidic ores, oxidic and/or carbonate-comprising ores, for example azurite $[Cu_3(CO_3)_2(OH)_2]$ or malachite $[Cu_2[(OH)_2|CO_3]]$, rare earth metals comprising ores like bastnaesite (Y, Ce, La)$CO_3F$, monazite (RE)$PO_4$ (RE=rare earth metal) or chrysocolla $(Cu,Al)_2H_2Si_2O_5(OH)_4.nH_2O$, noble metals in elemental form and their compounds to which a surface-modifying compound can become selectively attached to produce hydrophobic surface properties. Examples of noble metals that may be present as at least first material are Au, Pt, Pd, Rh, etc., preferably in the native state or as sulphides, phosphides, selenides, tellurides or as alloys with bismuth, antimony and/or other metals.

Examples of sulfidic ores which can be separated according to the invention are, for example, selected from the group of copper ores consisting of covellite CuS, molyb-denum(IV) sulfide, chalcopyrite (cupriferous pyrite) $CuFeS_2$, bornite $Cu_5FeS_4$, chalcocite (copper glass) $Cu_2S$, pendlandite $(Fe,Ni)_9S_8$, and mixtures thereof.

Suitable oxidic metal compounds which may be present as at least one second material according to the invention are preferably selected from the group consisting of silicon dioxide $SiO_2$, silicates, aluminosilicates, for example feldspars, for example albite $Na(Si_3Al)O_8$, mica, for example muscovite $KAl_2[(OH,F)_2AlSi_3O_{10}]$, garnets $(Mg, Ca, Fe^{II})_3(Al, Fe^{III})_2(SiO_4)_3$ and further related minerals and mixtures thereof.

Accordingly, untreated ore mixtures obtained from mines are preferably used as mixture comprising at least one first material and at least one second material in the process of the invention.

In a preferred embodiment of the process of the invention, the mixture comprising at least one first material and at least one second material in step (A) is in the form of particles having a size of from 100 nm to 100 μm, see for example U.S. Pat. No. 5,051,199. In a preferred embodiment, this particle size is obtained by milling. Suitable processes and apparatuses are known to those skilled in the art, for example wet milling in a ball mill. The mixture comprising at least one first material and at least one second material is therefore milled to particles having a size of from 100 nm to 100 μm before or during step (A) in a preferred embodiment of the process of the invention. Preferred ore mixtures have a content of sulfidic minerals of at least 0.4% by weight, particularly preferably at least 10% by weight.

Examples of sulfidic minerals which are present in the mixtures which can be used according to the invention are those mentioned above. In addition, sulfide of metals other than copper, for example, sulfides of iron, lead, zinc or molybdenum, i.e. FeS, $FeS_2$, PbS, ZnS or $MoS_2$, can also be present in the mixtures. Furthermore, oxidic compounds of metals and semimetals, for example silicates or borates or other salts of metals and semimetals, for example phosphates, sulfates or oxides/hydroxides/carbonates, and further salts, for example azurite $[Cu_3(CO_3)_2(OH)_2]$, malachite $[Cu_2[(OH)_2(CO_3)]]$, barite ($BaSO_4$), monazite ((La—Lu)$PO_4$), spinels (Mg, Ca, Fe(II))(Fe(III), Al, Cr)$_2O_4$, can be present in the ore mixtures to be treated according to the invention.

A typical ore mixture which can be separated by means of the process of the invention has the following composition: about 30% by weight of $SiO_2$ as an example of a preferred at least one second material, about 30% by weight of feldspar (e.g. $Na(Si_3Al)O_8$), about 3% by weight of $CuFeS_2$ as an example of a preferred at least one first material, about 0.05% by weight of $MoS_2$, balance chromium, iron, titanium and magnesium oxides.

The individual steps of the process of the invention are described in detail below:

Step (A):

Step (A) of the process according to the present invention can be conducted according to two alternative embodiments.

According to the first embodiment of the process according to the present invention, step (A) comprises contacting of the mixture comprising at least one first material and at least one second material with at least one magnetic particle, if appropriate in the presence of at least one dispersant.

According to this first embodiment only at least one magnetic particle is added in step (A), and at least one surface-modifying substance is added in step (C) of the process according to the present invention.

According to the second embodiment of the process according to the present invention, step (A) comprises contacting of the mixture comprising at least one first material and at least one second material with at least one magnetic particle and at least one surface-modifying substance at the same time, so that the at least one first material, the at least one surface-modifying substance and the at least one magnetic particle become attached to one another, if appropriate in the presence of at least one dispersant.

According to this second embodiment, both, at least one magnetic particle and at least one surface active substance are added in step (A). According to this embodiment, step (C) of the process according to the present invention is not necessary and is preferably not conducted.

Suitable preferred first and second materials have been mentioned above.

According to the present invention at least one magnetic particle is added in step (A). In a preferred embodiment of the process according to the present invention, at least one hydrophobic magnetic particle is added in step (A). In a preferred embodiment of the present invention, the at least one magnetic particle is hydrophobized at the surface.

In step (A) of the process of the invention, it is in general possible to use all magnetic substances and materials known to those skilled in the art. In a preferred embodiment, the at least one magnetic particle is selected from the group consisting of magnetic metals, for example iron, cobalt, nickel and mixtures thereof, ferromagnetic alloys of magnetic metals, for example NdFeB, SmCo and mixtures thereof, magnetic iron oxides, for example magnetite, maghemite, cubic ferrites of the general formula (II)

$$M^{2+}{}_xFe^{2+}{}_{1-x}Fe^{3+}{}_2O_4 \quad \text{(II)}$$

where

M is selected from among Co, Ni, Mn, Zn and mixtures thereof and x is ≤1, hexagonal ferrites, for example barium or strontium ferrite $MFe_6O_{19}$ where M=Ca, Sr, Ba, or a mixture thereof. The magnetic particles can additionally have an outer layer, for example of $SiO_2$.

In a particularly preferred embodiment of the present invention, the at least one magnetic particle is magnetite or cobalt ferrite $Co^{2+}{}_xFe^{2+}{}_{1-x}Fe^{3+}{}_2O_4$ where x≤1. Very preferably magnetite is used as at least one magnetic particle.

In a further preferred embodiment, in step (A) of the process according to the present invention, magnetic particles are present in the size of 100 nm to 100 μm, particularly preferred 1 to 50 μm. The magnetic particles may be brought into the adequate size by processes known to the skilled artisan, for example by milling. Furthermore, the particles, obtained from precipitation reaction, can be brought to the adequate particle size by setting up the reaction parameters (for example pH, reaction time, temperature).

In a further preferred embodiment, the at least one magnetic particle is hydrophobized at the surface by at least one hydrophobic compound. The hydrophobic compound is preferably selected from among compounds of the general formula (III)

$$B—Y \quad \text{(III)},$$

where

B is selected from among linear or branched $C_3$-$C_{30}$-alkyl, $C_3$-$C_{30}$-heteroalkyl, optionally substituted $C_6$-$C_{30}$-aryl, optionally substituted $C_6$-$C_{30}$-heteroaryl, $C_6$-$C_{30}$-aralkyl, and Y is a group by means of which the compound of the general formula (III) binds to the at least one magnetic particle.

In a particularly preferred embodiment, B is a linear or branched $C_6$-$C_{18}$-alkyl, preferably linear $C_8$-$C_{12}$-alkyl, very particularly preferably a linear $C_{12}$-alkyl. Heteroatoms which may be present according to the invention are selected from among N, O, P, S and halogens such as F, Cl, Br and I.

In a further particularly preferred embodiment, Y is selected from the group consisting of $—(X)_n—SiHal_3$, $—(X)_n—SiNHal_2$, $—(X)_n—SiH_2Hal$ where Hal is F, Cl, Br, I, $—(X)_n—Si(OR^1)_{3-n}$ wherein n is 1, 2 or 3 and $R^1$ is $C_1$-$C_6$-alkyl, and anionic groups such as $—(X)_n—SiO_3{}^{3-}$, $—(X)_n—CO_2{}^-$, $—(X)_n—PO_3{}^{2-}$, $—(X)_n—PO_2S^{2-}$, $—(X)_n—POS_2{}^{2-}$, $—(X)_n—PS_3{}^{2-}$, $—(X)_n—PS_2{}^-$, $—(X)_n—POS^-$, $—(X)_n—PO_{2-}$, $—(X)_n—CO_2{}^-$, $—(X)_n—CS_2{}^-$, $—(X)_n—COS^-$, $—(X)_n—C(S)NHOH$, $—(X)_n—S^-$ where X=O, S, NH, $CH_2$ and n=0, 1 or 2, and, if appropriate, cations selected from the group consisting of hydrogen, $NR_4{}^+$ where the radicals R are each, independently of one another, hydrogen or $C_1$-$C_8$-alkyl, an alkali metal, an alkaline earth metal or zinc, also $—(X)_n—Si(OZ)_3$ where n=0, 1 or 2 and Z=charge, hydrogen or short-chain alkyl radical.

If, in the mentioned formulas n=2, two equal or different, preferably equal, groups B are attached to one group Y.

Very preferred hydrophobizing substances of general formula (III) are alkyltrichlorosilane (alkyl group having 1 to 12 carbon atoms), alkyldialkoxysilane (alkyl group having 1 to 12 carbon atoms and alkoxy group having 1 to 6 carbon atoms), for example alkyldimethoxysilane (alkyl group having 1 to 12 carbon atoms), alkyltrialkoxysilane (alkyl group having 1 to 12 carbon atoms and alkoxy group having 1 to 6 carbon atoms), for example alkyltrimethoxysilane (alkyl group having 6 to 12 carbon atoms), octylphosphonic acid, lauric acid, oleic acid, stearic acid or mixtures thereof. Using alkyltrialkoxysilanes as hydrophobizing substances of general formula (III), preferably a polymeric hydrophobic layer is obtained at the surface of the magnetic particle.

The at least one magnetic particle is in general added in an amount that is high enough to have the complete amount of at least one first material embedded in agglomerates, preferably the at least one magnetic particle is added in excess. For example, the at least one magnetic particle is added in an amount of 0.1 to 20% by weight, preferably 0.5 to 5% by weight, in each case based on the amount of the complete mixture to be treated with the process according to the present invention.

According to the second embodiment of step (A) of the process according to the present invention, at least one surface-modifying substance is added. In general, all surface-modifying substances can be used according to the present invention that are able to modify the surface of the at least one first material in a way that agglomeration with at least one magnetic particle is possible.

For the purposes of the present invention, a "surface-modifying substance" is a substance which is able to modify the surface of the particle to be separated off in the presence of the other particles which are not to be separated off in such a way that attachment of a hydrophobic particle by means of hydrophobic interactions occurs. Surface-modifying substances which can be used according to the invention become attached to the at least one first material and thereby produce a suitable hydrophobicity of the first material.

In the process of the invention, preference is given to using a surface-modifying substance of the general formula (I)

$$A\text{-}Z \qquad (I)$$

which becomes attached to the at least one first material, where

A is selected from among linear or branched $C_2$-$C_{30}$-alkyl, $C_2$-$C_{30}$-heteroalkyl, optionally substituted $C_6$-$C_{30}$-aryl, optionally substituted $C_6$-$C_{30}$-heteroaryl, $C_6$-$C_{30}$-aralkyl, and Z is a group by means of which the compound of the general formula (I) binds to the at least one hydrophobic material.

In a particularly preferred embodiment, A is a linear or branched $C_2$-$C_{14}$-alkyl, very particularly preferably a linear $C_4$- or $C_8$-alkyl. Heteroatoms which may be present according to the invention are selected from among N, O, P, S and halogens such as F, Cl, Br and I.

In a further preferred embodiment, A is preferably a branched, $C_2$-$C_{20}$-alkyl, particularly preferably a branched $C_6$-$C_{14}$-alkyl, wherein preferably the at least one substituent, preferably having 1 to 6 carbon atoms, is attached in 2-position, for example 2-ethylhexyl and/or 2-propylheptyl. Corresponding compounds being substituted in 2-position are, for example, obtained using the Guerbet reaction that is known to the skilled artisan as one reaction step.

In a further particularly preferred embodiment, X is selected from the group consisting of anionic groups $—(X)_n—PO_3^{2-}$, $—(X)_n—POS_2^{2-}$, $—(X)_n—PS_3^{2-}$, $—(X)_n—PS_2^-$, $—(X)_n—POS^-$, $—(X)_n—PO_2^-$, $—(X)_n—PO_3^{2-}$, $—(X)_n—CO_2^-$, $—(X)_n—CS_2^-$, $—(X)_n—COS^-$, $—(X)_n—C(S)NHOH$, $—(X)_n—S^-$ where X is selected from the group consisting of O, S, NH, $CH_2$ and n=0, 1 or 2, with, if appropriate, cations selected from the group consisting of hydrogen, $NR_4^+$ with R being independently of one another hydrogen and/or $C_1$-$C_8$-alkyl, hydroxy-substituted $C_1$-$C_8$-alkyl or -heteroalkyl, like 2-hydroxy-ethyl $HO—CH_2CH_2—$ or 2-hydroxy-ethoxy-ethyl $HO—CH_2CH_2—O—CH_2CH_2—$, alkali- or earth alkali metals, preferably sodium or potassium, are present. The anions mentioned and the corresponding cations form, according to the invention, uncharged compounds of the general formula (I).

If, in the mentioned formulas n=2, two equal or different, preferably equal, groups A are attached to one group Z.

In a further preferred embodiment, compounds are applied, selected from the group consisting of xanthates $A\text{-}O—CS_2^-$, dialkyldithiophosphates $(A\text{-}O)_2—PS_2^-$, dialkyldithio-phosphinates $(A)_2\text{-}PS_2^-$, dialkyldithiocarbamates, alkyltrithiocarbamates, dithiophosphates and mixtures thereof, wherein A independently of one another is a linear or branched, preferably linear, $C_8$-$C_{20}$-alkyl, for example n-octyl, or a branched $C_6$-$C_{14}$-alkyl, wherein the branch is preferably located in 2-position, for example 2-ethylhexyl and/or 2-propylheptyl. As counterions, in these compounds preferably cations selected from the group consisting of hydrogen, $NR_4^+$ with R being independently of one another hydrogen and/or $C_1$-$C_8$-alkyl, hydroxy-substituted $C_1$-$C_8$-alkyl or -heteroalkyl, like 2-hydroxy-ethyl $HO—CH_2CH_2—$ or 2-hydroxy-ethoxy-ethyl $HO—CH_2CH_2—O—CH_2CH_2^-$, alkali- or earth alkali metals, preferably sodium or potassium, are present.

Exceptionally preferred compounds of general formula (I) are selected from the group consisting of sodium- or potassium-n-octylxanthate, sodium- or potassium-butylxanthate, sodium- or potassium-di-n-octyldithiophosphinate, sodium- or potassium-di-n-octyldithiophosphate, sodium- or potassium-di-n-octyldithiocarbamates and mixtures of these compounds.

In the case of noble metals, for example Au, Pd, Rh, etc., particularly preferred surface-modifying substances are monothiols, dithiols and trithiols, or 8-hydroxyquinolines, for example as described in EP 1200408 B1.

In the case of metal oxides, for example FeO(OH), $Fe_3O_4$, ZnO, etc., carbonates, for example azurite $[Cu(CO_3)_2(OH)_2]$, malachite $[Cu_2[(OH)_2CO_3]]$, particularly preferred surface-modifying substances are octylphosphonic acid (OPS), $(EtO)_3$ Si-A, $(MeO)_3$Si-A, with the abovementioned meanings of A.

In the case of metal sulfides, for example $Cu_2S$, $MoS_2$, $FeS_2$ etc., particularly preferred surface-modifying substances are monothiols, dithiols and trithiols, xanthogenates or dithiophosphates.

Therefore, according to the above mentioned, in a further preferred embodiment of the process of the invention, Z is $—(X)_n—CS_2^-$, $—(X)_n—PS_2^-$ or $—(X)_n—S^-$ where X is O and n is 0 or 1, and a cation is selected from among hydrogen, sodium, potassium and $NH_x(CH_2CH_2OH)_{4-x}$, wherein x is 0, 1, 2, 3, or 4.

The at least one surface-modifying substance is generally used in an amount which is sufficient to achieve the desired effect. In a preferred embodiment, the at least one surface-modifying substance is added in an amount of from 0.001 to 1% by weight, preferably 0.001 to 0.1% by weight in each case based on the total mixture to be treated.

According to the first embodiment of step (A) of the process according to the present invention, the contacting of the mixture with at least one magnetic particle in step (A) of the process of the invention can be carried out by all methods known to those skilled in the art, for example in bulk or in dispersion, preferably in suspension. In a preferred first embodiment, a dispersion of the at least one magnetic particle is added to the mixture.

In a preferred embodiment, the at least one magnetic particle is dispersed in a suitable dispersion medium. Suitable dispersion media are all dispersion media in which the at least one magnetic particle is not completely soluble. Suitable dispersion media are for example selected from the group consisting of water, water-soluble organic compounds, for example alcohols having from 1 to 4 carbon atoms, particularly preferably water.

According to the invention, the amount of dispersion medium for predispersing the magnetic particles can generally be selected so that a slurry or dispersion which is readily stirrable and/or conveyable is obtained. In a preferred embodiment, the amount of mixture to be treated based on the total slurry or dispersion is up to 100% by weight, preferably up to 60% by weight, for example 0.5 to 60% by weight, preferably 0.5 to 20% by weight, particularly preferably 0.5 to 10% by weight.

In one embodiment of the present invention, a high amount of mixture to be treated in the slurry or dispersion is preferred. Therefore, the present invention preferably relates to the process according to the present invention, wherein the amount of mixture to be treated based on the total slurry or dispersion is up to 60% by weight, for example 20 to 60% by weight.

According to the invention, the dispersion of the magnetic particles can be produced by all methods known to those skilled in the art. In a preferred embodiment, the magnetic particles to be dispersed and the appropriate amount of dispersion medium or mixture of dispersion media are combined in a suitable reactor, for example a stirring tank, and stirred by means of devices known to those skilled in the art, for example in a stirring tank by means of a magnetically operated propeller stirrer, for example at a temperature of from 1 to 80° C., preferably at room temperature.

According to the second embodiment of step (A) of the process according to the present invention, the contacting of the mixture with at least one magnetic particle and at least one surface-modifying substance at the same time is generally carried out by combining the components by methods known to those skilled in the art. For example, this second embodiment of step (A) can be carried out in bulk or in dispersion, preferably in suspension. Suitable dispersion media are for example selected from the group consisting of water, water-soluble organic compounds, for example alcohols having from 1 to 4 carbon atoms, and mixtures thereof. In a particularly preferred embodiment, the dispersion medium is water. In a preferred second embodiment, a dispersion of the at least one magnetic particle and at least one surface-modifying substance is added to the mixture.

The present invention therefore preferably relates to the process according to the present invention, wherein contacting of the mixture comprising at least one first material and at least one second material with at least one magnetic particle or with at least one magnetic particle and at least one surface-modifying substance at the same time in step (A) is achieved by addition of a mixture, preferably a dispersion, of least one magnetic particle and at least one surface-modifying substance.

In a further embodiment of the process of the invention, both embodiments of step (A) can be carried out in bulk, i.e. in the absence of a dispersion medium.

For example, the mixture to be treated and the at least one magnetic particle or at least one magnetic particle and the at least one surface-modifying substance are combined and mixed in the appropriate amounts without a further dispersion medium. Suitable mixing apparatuses are known to those skilled in the art, for example mills such as ball mills.

Step (A) is generally carried out at a temperature of from 1 to 80° C., preferably from 10 to 30° C.

According to the second embodiment of step (A), wherein at least one magnetic particle and at least one surface-modifying substance are added at the same time, the at least one magnetic particle becomes attached to the at least one first material that is more hydrophobic than the at least one second material by nature and that is further hydrophobized at its surface by the at least one surface-modifying substance. The bond between the two components is based on hydrophobic interactions. There is generally no bonding interaction between the at least one magnetic particle and the hydrophilic component of the mixture, so that these components do not become attached to one another. Thus, addition products of the at least one first, hydrophobic material and the at least one magnetic particle are present alongside the at least one second, hydrophilic material in the mixture after the second embodiment of step (A) of the process according to the present invention.

Step (B):

The optional step (B) of the process of the invention comprises addition of at least one dispersion medium to the mixture obtained in step (A) to give a dispersion having a suitable concentration.

In one embodiment, if step (A) is carried out in bulk, the mixture obtained in step (A) comprises at least one first material and at least second material, at least one magnetic particle and optionally at least one surface-modifying substance. If step (A) is carried out in bulk, step (B) of the process of the invention is preferably carried out, i.e. at least one suitable dispersion medium is added to the mixture obtained in step (A) in order to obtain a dispersion.

In the embodiment in which step (A) of the process of the invention is carried out in dispersion, step (B) is preferably not carried out. However, in this embodiment, too, it is possible to carry out step (B), i.e. to add further dispersion medium in order to obtain a dispersion having a lower concentration.

Suitable dispersion media are all dispersion media which have been mentioned above in respect of step (A). In a particularly preferred embodiment, the dispersion medium in step (B) is water.

Thus, step (B) comprises either converting the mixture present in bulk from step (A) into a dispersion or converting the mixture which is already in dispersion from step (A) into a dispersion of lower concentration by addition of dispersion media.

According to the invention, the amount of dispersion medium added in step (A) and/or step (B) can generally be selected so that a dispersion is obtained which is readily stirrable and/or conveyable. In a preferred embodiment, the amount of mixture to be treated based on the total slurry or dispersion is up to 100% by weight, preferably up to 60% by weight, for example 0.5 to 60% by weight, preferably 0.5 to 20% by weight, particularly preferably 0.5 to 10% by weight.

In one embodiment of the present invention, a high amount of mixture to be treated in the slurry or dispersion is preferred. Therefore, the present invention preferably relates to the process according to the present invention, wherein the amount of mixture to be treated based on the total slurry or dispersion is up to 60% by weight, for example 20 to 60% by weight.

In a preferred embodiment of the process of the invention, step (B) is not carried out but instead step (A) is carried out in aqueous dispersion so that a mixture in aqueous dispersion having the correct concentration for use in step (C) of the process of the invention is obtained directly in step (A).

The addition of dispersion medium in step (B) of the process of the invention can, according to the invention, be carried out by all methods known to those skilled in the art.

Step (C):

Step (C) of the process of the invention comprises contacting of the mixture from step (A) or (B) with at least one surface active substance, if this has not been done in step (A), so that the at least one first material, the at least one surface-modifying substance and the at least one magnetic particle become attached to one another.

Step (C) of the process according to the present invention is conducted, if at least one surface-modifying active substance is not added in step (A) of the process according to the present invention. According to this first embodiment of the process according to the present invention, a mixture comprising the at least one first material, the at least one second material, the at least one magnetic particle and optionally at least one dispersion medium, that is obtained in step (A) or (B), is introduced in step (C).

The at least one surface-modifying substance that is added in step (C) of the process according to the present invention and preferred embodiments thereof can be selected from the group of compounds of general formula (I) as mentioned in respect of step (A) of the process according to the present invention.

According to step (C) of the process according to the present invention, the at least one surface-modifying substance is generally used in an amount which is sufficient to achieve the desired effect. In a preferred embodiment, the at least one surface-modifying substance is added in step (C) of the process according to the present invention in an amount of from 0.001 to 1% by weight, preferably 0.001 to 0.1% by weight in each case based on the total mixture to be treated.

Step (C) of the process according to the present invention can in general be conducted according to all methods that are known to the skilled artisan. In particular, the addition according to step (C) of the process according to the present invention can be conducted as mentioned in respect of step (A) of this process.

Step (D):

Step (D) of the process of the invention comprises separation of the addition product from step (A), (B) or (C) from the mixture by application of a magnetic field. According to the present invention, the "addition product" in the sense of step (D) is the agglomerate that is obtained in step (A) or (C) containing at least one first material, at least one surface active substance and at least one magnetic particle.

In general, step (D) can be carried out with any magnetic equipment that is suitable to separate magnetic particles from dispersion, e.g. drum separators, high or low intensity magnetic separators, continuous belt type separators or others.

Step (D) can be carried out by introducing a permanent magnet into the reactor in which the mixture from step (A), (B) or (C) is present. In a preferred embodiment, a dividing wall composed of nonmagnetic material, for example the wall of the reactor, is present between permanent magnet and mixture to be treated. In a further preferred embodiment of the process of the invention, an electromagnet which is only magnetic when an electric current flows is used in step (D). Suitable apparatuses are known to those skilled in the art.

In a preferred embodiment, the magnetic separation equipment allows to wash the magnetic concentrate while the separation with a dispersant, preferably water. This washing preferably allows removing inert material from the magnetic concentrate leading to higher grades of the valuables.

In a preferred embodiment, step (D) is conducted continuously or semi-continuously, wherein preferably the mixture to be treated flows through a separator, preferably in dispersion. Flow velocities of the dispersion to be treated are in general adjusted to obtain an advantageous yield of magnetic agglomerates separated. In a preferred embodiment, flow velocities of the dispersion to be treated are 10 mm/sec. to 1000 mm/sec.

The pH-value of the dispersion which is treated according to step (D) is in general neutral or weakly basic, being a pH-value of 6 to 13, preferably 8 to 12. In a preferred embodiment, no adjustment of pH-value of the dispersion obtained in step (A) or (B) is necessary.

Step (D) of the process of the invention can be carried out at any suitable temperature, for example from 10 to 60° C., preferably at ambient temperature.

In a continuous or semi-continuous process the mixture is preferably mixed by turbulent flow, and is preferably not additionally stirred.

The magnetic agglomerates can be separated from the magnetic surface and/or the unit wherein magnetic separation is conducted according to the present invention by all methods known to those skilled in the art.

In a preferred embodiment the magnetic agglomerates are removed by flushing with a suitable dispersion medium. Suitable dispersion media have been mentioned above. In a preferred embodiment, water is used to flush the separated magnetic agglomerates.

After step (D) of the process according to the present invention, the agglomerate of at least one first material that is to be separated according to the present invention, at least one surface-modifying substance and at least one magnetic particle is separated from the at least one second material. Preferably both fractions that are obtained are present as dispersions in at least one dispersion medium, preferably in water.

Step (E):

Optional step (E) of the process of the invention comprises cleavage of the addition product which has been separated off in step (D) to obtain the at least one first material and the at least one magnetic particle separately.

In a preferred embodiment of the process of the invention, the cleavage in step (E) is carried out in a nondestructive manner, i.e. the individual components present in the dispersion are not changed chemically. For example, the cleavage according to the invention is preferably not affected by oxidation of the hydrophobizing agent, for example to give the oxidation products or degradation products of the hydrophobizing agent.

Cleavage can be carried out by all methods known to those skilled in the art which are suitable for cleaving the addition product in such a way that the at least one magnetic particle can be recovered in reusable form. In a preferred embodiment, the magnetic particle which has been cleaved off is reused in step (A) of the process according to the present invention.

In a preferred embodiment, the cleavage in step (E) of the process of the invention is affected by treatment of the addition product with a substance selected from the group consisting of organic solvents, basic compounds, acidic compounds, oxidants, reducing agents, surface-active compounds and mixtures thereof.

Examples of basic compounds which can be used according to the invention are aqueous solutions of basic compounds, for example aqueous solutions of alkali metal and/or alkaline earth metal hydroxides, for example KOH, NaOH, lime water, aqueous ammonia solutions, aqueous solutions of organic amines of the general formula $R^2{}_3N$, where the radicals $R^2$ are selected independently from the group consisting of $C_1$-$C_8$-alkyl which may optionally be substituted by further functional groups.

Examples of surface-active compounds which can be used according to the invention are nonionic, anionic, cationic and/or zwitterionic surfactants. In a preferred embodiment, the cleavage is made by the use of biodegradable, preferably nonionic, surfactants with concentrations in the range of the critical micelle concentrations. In a preferred embodiment, the addition product of hydrophobic material and magnetic particle is cleaved by means of biodegradable nonionic surfactants, further preferably added in an amount slightly, for example up to 5%, more preferably up to 3%, above the critical micelle concentration of the surfactant.

After optional cleavage according to step (E), the at least one first material and the at least one magnetic particle are, according to the invention, present as dispersion in the above-mentioned cleavage reagent, preferably in a mixture of water and surfactant.

For example, the at least one magnetic particle is separated from the dispersion comprising this at least one magnetic particle and the at least one first material by means of a permanent magnet or electromagnet. Details of the separation are analogous to step (D) of the process of the invention.

The first material to be separated off, preferably the metal compound to be separated off, is preferably separated from the dispersion medium by drying.

The process according to the present invention comprises steps (A) to (D), wherein particles or agglomerates are obtained comprising at least one magnetic particle and at least one metal. In a particularly preferred embodiment these particles or agglomerates are suitable for direct work-up without optional step (E) according to the present invention to obtain the at least one metal in pure form.

The present invention further relates to the process according to the present invention, wherein after step (D) or step (E) the following step (F) is conducted:

(F) further processing of the particles or of the agglomerate from step (D) or (E) via smelting, extracting and/or wet chemical refining.

The magnetic particles or agglomerates obtained in step (D) preferably comprise iron comprising magnetic substances or magnetic particles in addition to at least one first material, being for example at least one precious metal. Because iron is essentially necessary for melting and/or smelting processes to obtain the at least one first material in pure or enriched form, the particles or agglomerates that are obtained in step (D) of the process according to the present invention can directly be treated in a smelting and/or melting process.

In the case that noble metals are used as first material in combination with iron comprising magnetic particles, no need for further addition of other iron containing compounds may exist. Instead, the magnetic iron oxide particles loaded with precious metals are added to the furnace feed in place of iron oxide otherwise added to the process.

In a further embodiment of the process according to the present invention, step (F) is conducted according to the present invention after step (E).

Smelting, extracting and/or wet chemical refining are conducted according to methods that are known to the skilled artisan.

Figures:

FIG. 1 shows a diagram, wherein a process for separating valuables from the gangue of an ore according to the prior art, wherein surface-modifying substance and magnetite are added in two steps (diamonds) is compared to the process according to the present invention, wherein surface-modifying substance and magnetite are added in one step (square). The x-axis shows time in minutes, the y-axis shows a value that is corresponding to the particle size in μm.

In the case of the process according to the present invention, both, surface-modifying substance and magnetite are added at t=0 min. In the case of the process according to the prior art, surface-modifying substance is added at t=0 min, and magnetite is added at t=about 37 min. (left vertical line). At about 72 min (right vertical line), a surfactant is added to separate the agglomerates, in both cases.

EXAMPLES

A roughly premilled porhyric copper ore from south America (0.66 wt % Cu, 0.029 wt % Mo) is milled to d80=about 40 μm without the addition of any additive. After milling, the pulp having a solid content of 60 wt % is treated with octyl xanthate (400 g/t) and hydrophobic magnetite (3 wt %) in varying orders. Treatment is conducted in a beaker under stirring using an inertly coated paddle mixer. Subsequently, the pulp is diluted to a solid content of 15 wt % and is separated magnetically. Results in respect of recovery and grade of copper and molybdenum are shown in table 1.

TABLE 1

| | Examples No. | | | | | |
|---|---|---|---|---|---|---|
| | 1 | 2 | 3 | 4 | 5 | 6 |
| Time of addition of xanthate [min] | 15 | 15* | 30 | 15 | 10 | 5 |
| Time of addition of magnetite [min] | 15 | 15* | | | | |
| Cu Recovery [wt %] | 93 | 92 | 89 | 95 | 95 | 95 |
| Mo Recovery [wt %] | 94 | 90 | 88 | 94 | 94 | 91 |
| Cu Grade [%] | 18.2 | 17.8 | 17.9 | 17.9 | 16.9 | 17.1 |
| Mo Grade [%] | 0.62 | 0.56 | 0.61 | 0.61 | 0.55 | 0.53 |

*reversed order

In examples 1 and 2 at t=0 min, the first substance (xanthate or magnetite) is added, after 15 min the other substance (xanthate or magnetite) is added, then it is stirred for 15 min, before agglomerates are treated as mentioned above.

In examples 3 to 6 both substances (xanthate and magnetite) are added at t=0 min, after stirring for the time as mentioned in table 1, the agglomerates are treated as mentioned above.

The invention claimed is:

1. A process for separating at least one first material from a mixture comprising at least one first material and at least one second material, which comprises the following steps:

(A) contacting of the mixture comprising at least one first material and at least one second material with at least one magnetic particle and at least one surface-modifying substance at the same time, so that the at least one first material, the at least one surface-modifying substance and the at least one magnetic particle become attached to one another, and optionally in the presence of at least one dispersant, (B) optionally, adding at least one dispersion medium to the mixture obtained in step (A) to give a dispersion having a suitable concentration, (C) separating the addition product from step (A) or (B) from the mixture by application of a magnetic field, (D) optionally, cleavage of the addition product which has been separated off in step (C) to obtain the at least one first material and the at least one magnetic particle separately.

2. The process according to claim 1, wherein the first material is a hydrophobic metal compound or coal and the second material is a hydrophilic metal compound.

3. The process according to claim 2, wherein the at least one hydrophobic metal compound is selected from the group consisting of sulfidic ores, oxidic ores, carbonate-comprising ores, noble metals in elemental form, compounds comprising noble metals and mixtures thereof.

4. The process according to claim 2, wherein the at least one hydrophilic metal compound is selected from the group consisting of oxidic metal compounds, hydroxidic metal compounds and mixtures thereof.

5. The process according to claim 1, wherein the surface-modifying substance is a substance of the general formula (I)

$$A\text{-}Z \quad (I)$$

where

A is a linear or branched $C_2$-$C_{30}$-alkyl, $C_3$-$C_{30}$-heteroalkyl, optionally substituted $C_6$-$C_{30}$-aryl, optionally substituted $C_6$-$C_{30}$-heteroaryl, $C_6$-$C_{30}$-aralkyl, and Z is a group by means of which the compound of the general formula (I) binds to the at least one hydrophobic material.

6. The process according to claim 5, wherein Z is selected from the group consisting of anionic groups $—(X)_n—PO_3^{2-}$, $—(X)_n—PO_2S^{2-}$, $—(X)_n—PS_3^{2-}$, $PS_2^-$, $—(X)_n—POS^-$, $—(X)_n—CO_2^-$, $—(X)_n—C(S)NHOH$ and $—(X)_n—S^-$ where X is selected from the group consisting of O, S, NH and $CH_2$ and n=0, 1 or 2, with, and optionally, cations selected from the group consisting of hydrogen, $NR_4^+$ with R being independently of one another hydrogen and/or $C_1$-$C_8$-alkyl, hydroxy-substituted $C_1$-$C_8$-alkyl or -heteroalkyl, alkali- or earth alkali metals.

7. The process according to claim 1, wherein the at least one magnetic particle is selected from the group consisting of magnetic metals, ferromagnetic alloys of magnetic metals, magnetic iron oxides, hexagonal ferrites and mixtures thereof.

8. The process according to claim 1, wherein the at least one magnetic particle is selected from the group consisting of a. iron,
b. cobalt,
c. nickel
d. mixtures of iron, cobalt and/or nickel,
e. NdFeB,
f. SmCo
g. and mixtures of NdFeB and SmCo,
h. magnetite,
i. maghemite,
j. cubic ferrites of the general formula (II)

$$M^{2+}_xFe^{2+}_{1-x}Fe^{3+}_2O_4 \quad (II)$$

where

M is selected from among Co, Ni, Mn, Zn and mixtures thereof and x is ≤1, k. hexagonal ferrites and
l. mixtures thereof.

9. The process according to claim 1, wherein the dispersion medium is water.

10. The process according to claim 1, wherein the mixture comprising at least one first material and at least one second material is milled to particles having a size of from 100 nm to 100 μm before or during step (A).

11. The process according to claim 1, wherein contacting the mixture comprising at least one first material and at least one second material with at least one magnetic particle and at least one surface-modifying substance at the same time in step (A) is achieved by addition of a mixture, of least one magnetic particle and at least one surface-modifying substance.

12. The process according to claim 1, wherein contacting the mixture comprising at least one first material and at least one second material with at least one magnetic particle and at least one surface-modifying substance at the same time in step (A) is achieved by addition of a dispersion, of least one magnetic particle and at least one surface-modifying substance.

* * * * *